United States Patent [19]

Baker

[11] 4,415,024

[45] Nov. 15, 1983

[54] HEAT EXCHANGER ASSEMBLY

[75] Inventor: Robert L. Baker, Amherst, N.Y.

[73] Assignee: Joy Manufacturing Company, Pittsburgh, Pa.

[21] Appl. No.: 204,321

[22] Filed: Nov. 5, 1980

[51] Int. Cl.[3] ..... F28D 7/00

[52] U.S. Cl. ..... 165/160; 165/159; 165/78; 165/111

[58] Field of Search ..... 165/160, 159, 78; 62/506, 93

[56] References Cited

U.S. PATENT DOCUMENTS

| | | | |
|---|---|---|---|
| 2,335,479 | 11/1943 | Berkeley et al. | 165/160 |
| 2,362,117 | 11/1944 | David | 165/78 |
| 3,532,160 | 10/1970 | Garrison | 165/159 |

FOREIGN PATENT DOCUMENTS

| | | | |
|---|---|---|---|
| 1243942 | 8/1971 | United Kingdom | 165/159 |
| 2027864 | 2/1980 | Fed. Rep. of Germany . | |
| 1596001 | 8/1981 | United Kingdom . | |

*Primary Examiner*—William R. Cline
*Assistant Examiner*—John F. McNally
*Attorney, Agent, or Firm*—Raymond W. Augustin

[57] ABSTRACT

A heat exchanger assembly has an elongated shell provided with fluid inlet and fluid outlet openings. An elongated bundle assembly is received within the shell. The bundle assembly has a plurality of elongated tubes extending generally longitudinally and a plurality of generally parallel fin plates which are transversely oriented. The bundle assembly has a top sheet and a bottom sheet. The bundle assembly support is interposed between the bottom sheet and the shell. A baffle is provided in the form of an elongated plate extending generally diagonally between the top sheet of the bundle assembly and the shell. In a preferred form, the baffle plate is provided with an underlying seal which is interposed between the baffle plate and the top sheet and has an upper edge which is of generally complementary curvature with respect to the adjacent portions of the shell and may take the form of a portion of a sine wave. The bundle assembly support may provide cooperation to facilitate insertion of the bundle assembly into the shell and removal of the same therefrom. The bundle assembly support may cooperate with the shell in defining a condensate receipt reservoir.

19 Claims, 9 Drawing Figures

HEAT EXCHANGER ASSEMBLY

FIELD OF THE INVENTION

This invention relates to heat exchanger assemblies having improved sturctural means for resisting short circuiting of fluid flow and improving the efficiency of heat transfer.

BACKGROUND OF THE INVENTION

In intercoolers employed in multistage centrifugal compressors, as well as in other related heat exchangers, gas is introduced into the heat exchanger, is caused to pass over coolant containing tubes whereby heat is transferred from the gas to the coolant with the gas being subsequently emitted through a discharge outlet.

One known embodiment of heat exchanger of the above-described type is disclosed in U.S. Pat. No. 3,532,160. An elongated cylindrical shell is provided with a gas inlet and a gas outlet and an octagonally shaped array of tubes contained within a tube bundle. A complex series of walls above the bundle define a series of baffles which serve to resist short-circuiting flow, but tend to result in gaseous flow over only a relatively small portion of the coolant containing tubes as the gas flows from the inlet to the outlet. Further, such a construction requires extensive fabrication and, as to certain portions, requires detailed attention to mechanical tolerances.

There remains a substantial need for an efficient heat exchanger which is adapted for use as an intercooler in centrifugal compressors, as well as in other environments, wherein improved efficiency of heat transfer is provided while facilitating ease of economical manufacture and maintenance of the equipment.

SUMMARY OF THE PRESENT INVENTION

The above-described need has been met by the present invention.

The present invention provides an elongated shell having fluid inlet and outlet means and an elongated bundle assembly which has a plurality of longitudinally extending tubes and transverse, generally parallel fin plates. The bundle assembly has top and bottom sheets and cooperates with bundle assembly support means.

Baffle means are interposed between the top sheet and the shell. The baffle means include an elongated baffle plate which extends longitudinally, generally diagonally of the bundle assembly between the fluid inlet and outlet means. First seal means cooperate with the lower edge of the baffle plate, which is preferably planar, and the upper sheet so as to resist undesired short circuiting flow of gas. The upper edge of the baffle plate preferably is of substantially complementary configuration with respect to the adjacent shell portion.

The heat exchanger assembly of the present invention also provides an inverted channel member in underlying supporting relationship with respect to the bundle assembly. The channel member cooperates with transport means to facilitate ready insertion of the bundle assembly into the shelf and removal therefrom.

The channel member also cooperates with the underlying shell portion to define a condensate receiving reservoir. Appropriate drain means are provided to remove collected condensate from the reservoir.

It is an object of the present invention to provide a heat exchanger which offers improved efficiency of heat exchange between a gaseous material and coolant containing tubes through increased exposure of the gaseous material to the tubes, with minimum loss of pressure.

It is another object of the present invention to provide an improved baffle construction which effectively resists undesired short circuiting flow of the gaseous material while providing maximum exposure of the gaseous material to the coolant containing tubes.

It is another object of the present invention to provide a heat exchanger assembly which is adapted for economical manufacture and maintenance.

It is a further object of the present invention to provide such that a heat exchanger assembly which includes efficient means for collecting and withdrawing condensate obtained from the gas as the temperature is reduced.

These and other objects of the invention will be more fully understood from the following description of the invention on reference to the illustrations appended hereto.

DESCRIPTION OF THE PREFERRED EMBODIMENTS

Figure 1:
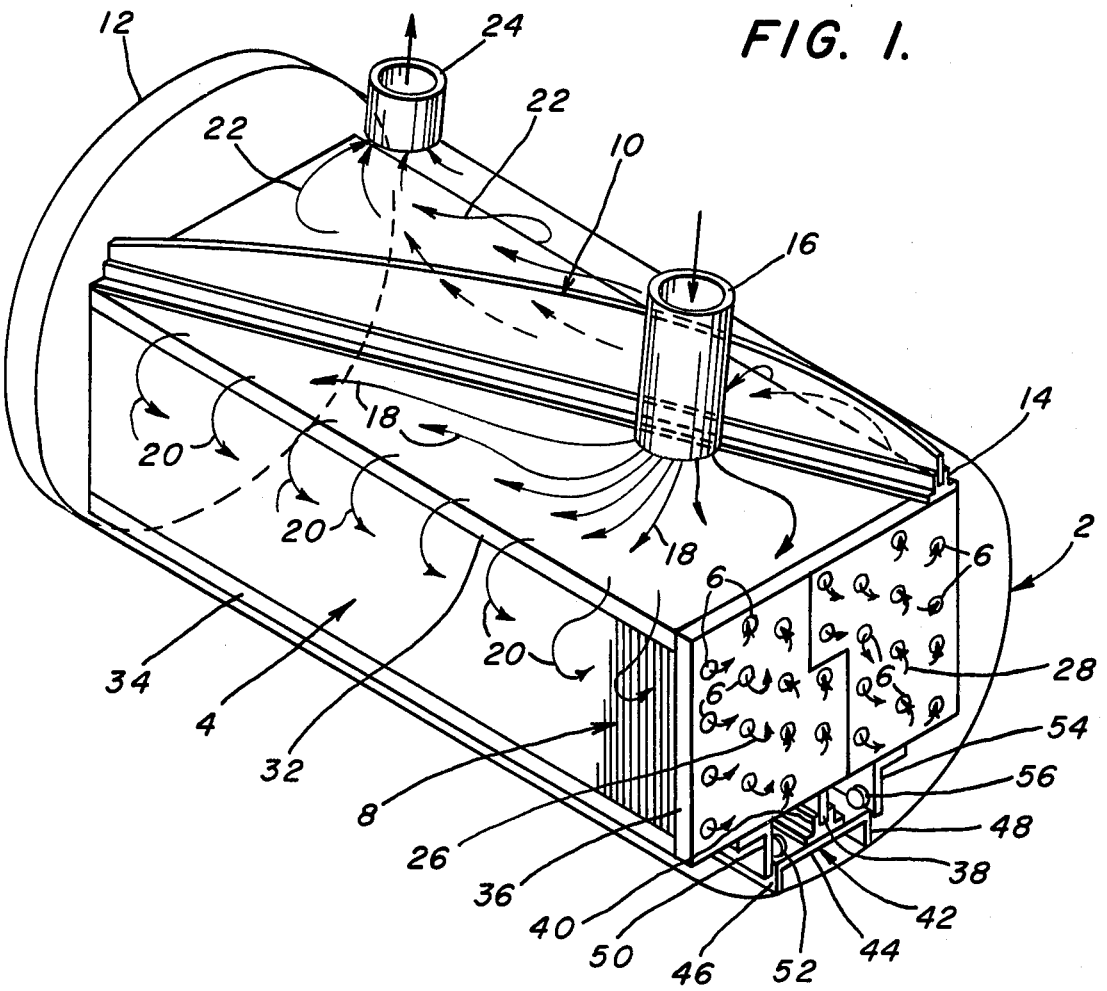
FIG. 1 is a schematic illustration of a preferred embodiment of the invention.

Referring now in greater detail to FIG. 1, there is shown a schematic illustration of the bundle assembly and other portions of the heat exchanger assembly. The inner diameter of the shell within which the bundle assembly and associated components are received is generally indicated by the reference number 2. The bundle assembly 4 consists of a plurality of elongated tubes 6 which extend generally longitudinally within the bundle assembly and a plurality of transversely oriented fin plates 8 which are generally parallel to each other. In operation of the heat exchanger, coolant flows through the tubes 6 and the gas to be cooled flows along the openings between adjacent fin plates 8.

A baffle 10, which will be described in greater detail hereinafter, is disclosed intermediate the upper portion of the bundle assembly 4 and the shell (not shown in this view) and serves to resist undesired short circuiting of the flow of gas, while providing maximum exposure of the gas to the full length of the bundle assembly. A front tubesheet 12, in the form shown, is generally circular and is of substantially larger cross sectional area than the bundle assembly 4. A first seal member 14 which will be described in greater detail below, preferably has a lower sealing surface in contact with top sheet 32 of the bundle assembly and has an upwardly open channel which receives the lower edge of the baffle 10. The first seal member 14 is preferably substantially coextensive with the longitudinal extent of baffle 10 and preferably has a substantially uniform cross-sectional configuration throughout its length.

In operation, the gas to be cooled will enter through gas inlet 16 and as a result of the presence of the baffle means, consisting of baffle plate 10 and seal 14, will travel in the directions of the arrows 18 on the surface of top sheet 32 of bundle assembly 4 and then downwardly in the direction of the arrows 20 through the space between the fin plates 8 emerging at the opposite side thereof after yielding heat to the coolant contained within tubes 6. The gas will then, as shown by arrows 22, be emitted from the heat exchanger assembly through discharge outlet 24. It will be appreciated that as the baffle plate 10 is oriented longitudinally generally diagonally with respect to the bundle assembly 4 and is interposed between the gas inlet 16 and gas outlet 24, short circuiting of the gas is resisted and flow through essentially the full longitudinal extent of the bundle assembly by the gas to be cooled as is indicated by arrows 18, 20, 22 is provided.

The bundle assembly 4, in addition to having front tubesheet 12 also is provided with rear tubesheet 36, top sheet 32 and bottom sheet 34. In the form shown, the bundle assembly 4 has a substantially rectangular cross-sectional configuration. This configuration facilitates ease of manufacture, as well as ease of insertion and removal of the bundle assembly 4 from the shell 2. In addition, this configuration contributes to efficiency of performance as will be described hereinafter.

As is shown in FIG. 1, the rear tubesheet 36 has a plurality of openings receiving tubes 6. The flow which is controlled by a header member (not shown in this view) results in coolant flowing to the rear end of the bundle assembly 4 (as shown by flow arrows indicated generally by 26) and return flow to the front end (as indicated generally by arrows 28). Return header 68 has a divider wall construction contacting rear tubesheet 36 so as to confine coolant flow to the patterns indicated by arrows 26. Corresponding divider walls are provided in supply header 66. While a single divider wall on the return header can provide the flow illustrated, a pair of divider walls on supply header 66 are needed.

Referring still to FIG. 1, there is shown a form of bundle assembly support means in the form of inverted channel 42 which has an upper plate portion 44 and a pair of generally perpendicularly oriented downwardly projecting legs 46, 48. As will be described in greater detail below, a bundle seal plate 38 projects generally perpendicularly downwardly from bottom sheet 34. A second seal member 40, which may be substantially of the same configuration as first seal member 14, has a lower surface in surface-to-surface contact with channel upper plate portion 44 and an upwardly open channel which receives bundle seal plate 38. In this fashion, flow of gas between the undersurface of bottom sheet 34 and upper surface of channel upper plate portion 44 is resisted.

A further feature of the present invention is that it is contemplated that the bundle assembly may readily be moved longitudinally into and out of the surrounding shell. In order to facilitate efficient movement, a pair of downwardly projecting guide members 50, 54, which in the form shown are angle irons, are secured to the lower surface of bottom sheet 34 and are in close proximity with the outer surfaces of channel legs 46, 48, respectively. This serves to resist undesired lateral movement of the bundle assembly 4 as longitudinal insertion or removal is effected. In order to facilitate such movement, roller 52 is attached to guide 50 and is adapted to roll on the upper surface of channel web 44. Similarly, roller 56 is secured to guide 54 and is adapted to roll on the upper surface of web 44. In the form illustrated, in FIG. 1 a pair of such opposed guide members and rollers is positioned at or adjacent to the rearward extremity of the bundle assembly 4. It will be appreciated, however, that additional such guide and roller members may be provided along the longitudinal extent of the bundle assembly 4, if desired.

Figure 2:
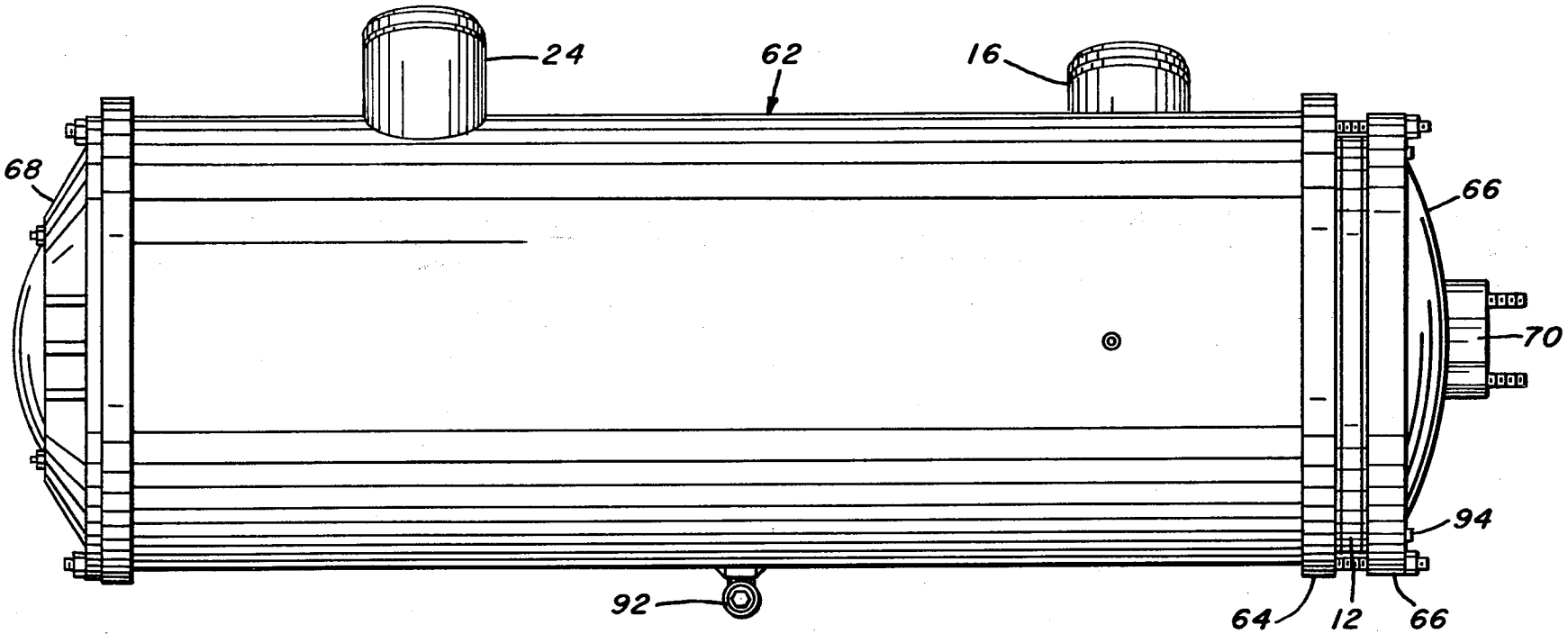
FIG. 2 is a side elevational view of a heat exchanger of the present invention.

Referring now to FIG. 2 there is shown a side elevational view of the outer generally cylindrical shell 62 through which passes at longitudinally spaced positions gas inlet 16 and gas outlet 24. To the right hand portion of FIG. 2 is shown as annular radially outwardly projecting flange 64 which is formed on the cylindrical shell, the front tubesheet 12 of the bundle assembly 4 and the supply header 66, which in the form shown is bolted to the cylindrical shell flange 64 so as to secure the bundle assembly 4 in position. Cooling fluid, such as water, is introduced into the supply header 66 through coolant inlet 70. At the left extremity of the shell 62 is the return header 68 which seals that end of the shell and permits the coolant to return to the supply header 66 for withdrawal through the coolant outlet 72 (FIG. 3).

Figure 4:
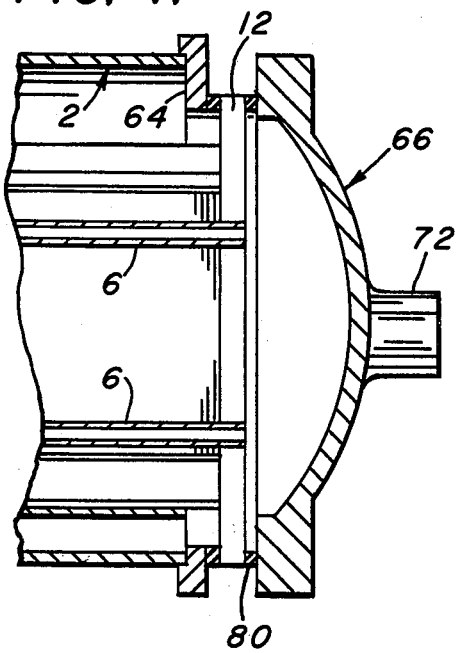
FIG. 4 is a fragmentary cross sectional view taken through 4—4 of FIG. 3.
Figure 3:
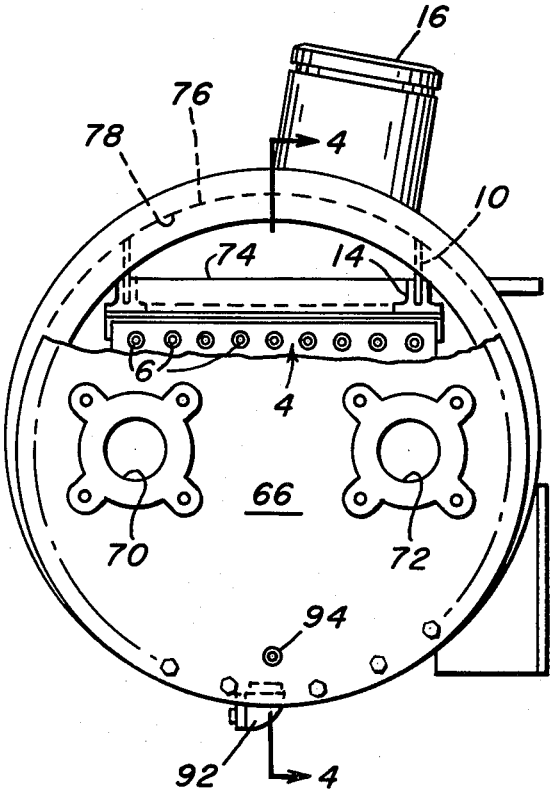
FIG. 3 is a partially broken away front end elevational view of the heat exchanger shown in FIG. 2.

Referring now to FIGS. 3 and 4, there is shown a partially broken away end view of the front end of the heat exchanger assembly. Also shown is the coolant inlet 70 and the coolant outlet 72, with the former serving to provide a fresh supply of cooling medium, such as water and the latter serving to withdraw coolant at elevated temperature.

As is shown in FIG. 3, the seal member 14 has an upper edge 74. Further, the upper edge 76 of baffle 10 is generally in complementary surface-to-surface contact with the inner edge of shell 78, thereby serving to resist undesired passage of gas therebetween.

Referring now to FIG. 4, the front or supply header 66 is secured to flange 64 of the shell 2 by any suitable means as by bolts and nuts (not shown). It will be appreciated that the front tubesheet 12 is of larger diameter than the opening defined by flange 64. Also, annular gasket 80 serves to provide a seal between supply header 66 and the front tubesheet 12 when the fasteners are in secured position.

Figure 6:
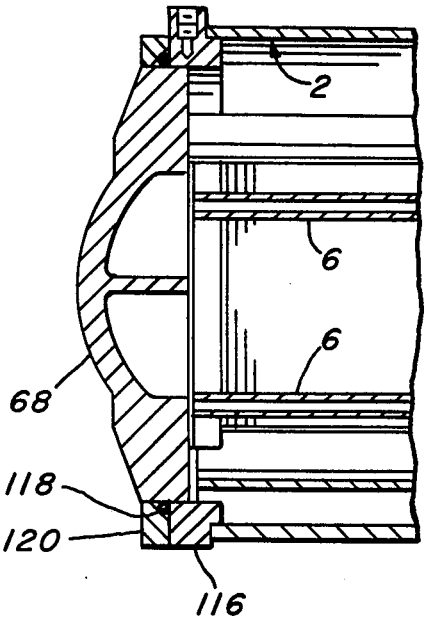
FIG. 6 is a fragmentary cross-sectional illustration taken through 6—6 of FIG. 5.
Figure 5:
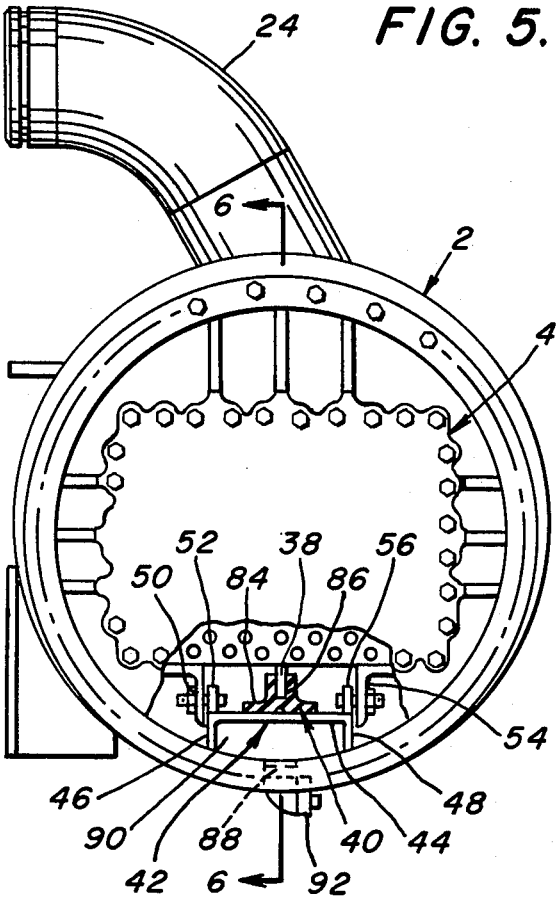
FIG. 5 is a partially broken away rear end elevational view of the heat exchanger assembly shown in FIG. 2.

Referring now to FIGS. 5 and 6 in detail, further features of the invention will be considered. Referring to FIG. 5 there is shown the channel 42 and the interrelationship between the channel 42 and the second seal member 40. It is noted that the seal 40, which is preferably of substantially uniform cross section throughout its longitudinal extent, has a substantially flat base portion 84 in surface-to-surface contact with web 44 and an upwardly open channel 86 which is in intimate contact with and receives bundle seal plate 38. The seals 14, 40 may be made of any suitable material, but among the preferred materials are extruded silicone rubber.

FIG. 5 also shows further details of the arrangement of the guides 50, 54 and their associated rollers 52, 56 which serve to cooperate with the channel 42 in providing a track for relative longitudinal movement of the bundle assembly 4 into and out of the shell 2.

Referring still to FIG. 5, it will be seen that legs 46, 48 of channel 42 are in contact with the shell 2 adjacent the lower portion thereof. The channel 42 cooperates with wall sector 88 of the shell 2 to define a reservoir 90 for receipt of condensate moisture which might be yielded from the gas as its temperature is reduced. The channel 42, therefore serves the multiple purposes of cooperating with the seal 40 to resist undesired passage of gas under the bundle assembly 4, providing a track for permitting readily controlled movement of the bundle assembly 4 into and out of the shell 2 and cooperating with the shell to define condensate reservoir 90. An opening in wall 88 permits communication between reservoir 90 and drain 92 for removal of accumulated condensate moisture from the reservoir 90. In the form shown in FIG. 3, a further drain 94 is provided within supply header 66.

Figure 9:
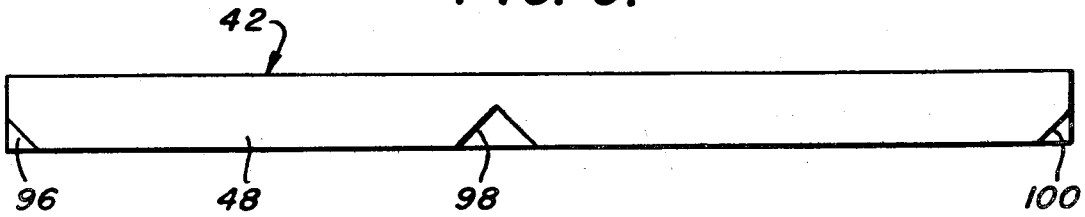
FIG. 9 is a side elevational view of the form of bundle assembly support means of the present invention.

Referring now to FIGS. 5 and 9 it will be noted that in the preferred form the channel 42 is substantially coextensive in length with the shell 2 in order to provide for effective support during insertion of the bundle assembly 4 operation of the equipment and removal of the bundle assembly 4. In order to facilitate entry of condensate moisture into the reservoir openings such as 96, 98, 100 are provided in leg 48 of channel 42. Openings such as 98 are preferably provided solely on leg 48 which is exposed to side of bundle assembly 4 from which emerges cooled gas. Openings 96, 100 are preferably substantially smaller than opening 98 and preferably have an area of less than about 0.1 square inch each. Openings (not shown) corresponding generally in size to openings 96, 100 may be provided in leg 46 to permit passage of any condensate on the "hot side" to reservoir 90. Openings such as 96, 100 are of insufficient size to create any appreciable problem in respect of pressure balance if placed in leg 46.

Figure 7:
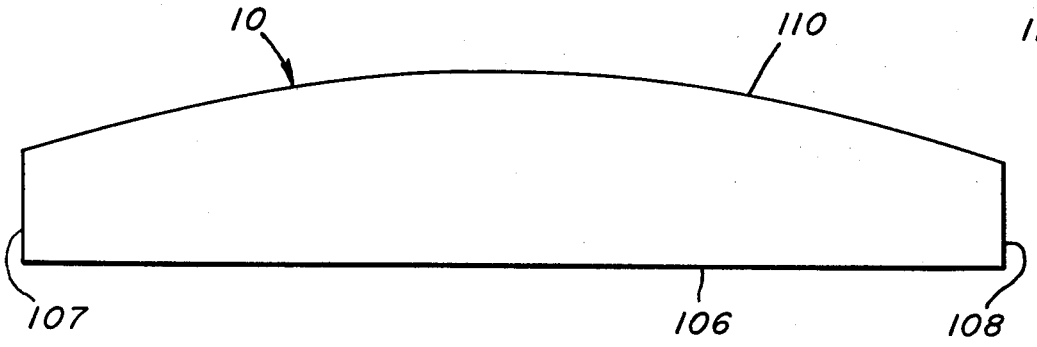
FIG. 7 is a side elevational view of the baffle plate shown in FIG. 1.
Figure 8:
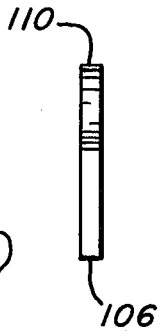
FIG. 8 is an end elevational view of the baffle plate shown in FIG. 7.

Referring now to FIGS. 7 and 8, more detailed consideration will be given to a preferred form of baffle plate 10 of the present invention. In a preferred embodiment the baffle plate 10 will be planar and have a substantially flat lower edge 106 which is received within first seal 14. End 107, 108 will, in the form shown in FIG. 1, be positioned at or adjacent the diagonal corners of top sheet 32. The upper surface 110 will have a complementary configuration with respect to the adjacent surface of the inner wall of shell 2. The seal 14 will resist undesired passage of gas between the baffle 10 and the top sheet 32, while the close fit between upper surface 110 and the inner shell adjacent portions will resist short circuiting gas flow between the inlet 16 and outlet 24 through the zone between top surface 110 and the shell 2. This facilitates uniform gas flow velocity through the bundle assembly. In a preferred embodiment the baffle top surface 110 will be welded to shell 2 and the contour of the top surface 110 will be a portion of a sine wave. In a preferred embodiment the baffle may be made of steel and have a thickness of about $\frac{1}{8}$ inch to $\frac{3}{8}$ inch.

This baffle arrangement also permits flexibility of design in respect of positioning of inlet 16 and outlet 24.

Referring now to FIG. 6 in greater detail the return header 68 is secured to the bundle rear tubesheet 36 by means of suitable fasteners such as bolts (not shown in this view) an O-ring 118 is secured in sealing relationship with respect to flange 116 by lantern ring 120 as by suitable fasteners, such as bolts (not shown in this view).

One of the advantageous aspects of the present invention arises from the use of seals 14, 40. As a result of the resilient nature of the sealing material and the shape of the same, effective sealing between the baffle plate 10 and the bundle assembly 4, as well as between the bundle assembly 4 and the support channel 42 may be effected without the need to maintain very precise tolerances in respect of the component parts. This serves as both a functional and economic advantage. Also, the use of a rectangular bundle assembly facilitates efficient sealing, reduced manufacturing time and costs and improved ease of maintenance.

It will be appreciated that the heat exchanger assembly of the present invention may advantageously function as an intercooler in a multistage centrifugal compressor as well as functioning in a wide range of environments wherein cooling of a gaseous media is desired.

It will be appreciated, therefore, that the present invention provides an efficient heat exchanger assembly which is economical to manufacture and use and provides for higher efficiency heat transfer as the baffle plate resists short circuiting flow between the gas inlet and outlet and forces the gas to be cooled to pass through essentially all of the longitudinal extent of the bundle assembly. Further, means are provided for guiding the bundle assembly into and out of the shell, thereby facilitating ease of substitution and permitting the use of different tube pitch cores within a given shell. The apparatus also provides for uniform gas flow velocity through the bundle assembly. Also, integral and efficient means for collecting and withdrawing condensate from the assembly is provided. Further, as a result of the sealed assembly of the return header, access to that end of the heat changer interior is readily obtained.

Whereas particular embodiments of the invention have been described above, for the purposes of illustration, it will be evident to those skilled in the art that numerous variations of the details may be made without departing from the invention as defined in the appended claims.

What is claimed is:

1. A heat exchanger assembly comprising an elongated shell having a fluid inlet and a fluid outlet, an elongated bundle assembly received within said shell, said bundle assembly having a plurality of elongated tubes extending generally longitudinally within said bundle assembly and a plurality of generally parallel fin plates oriented generally transversely with respect to said elongated tubes, said bundle assembly having a top sheet and a bottom sheet, bundle assembly support means interposed between said bottom sheet and said elongated shell, baffle means interposed between said top sheet and said elongated shell, said baffle means separating said fluid inlet and said fluid outlet, and said baffle means including an elongated baffle plate extending longitudinally generally diagonally on said bundle assembly between said fluid inlet and said fluid outlet, whereby said baffle plate directs said fluid through the full longitudinal extent of said bundle.

2. The heat exchanger assembly of claim 1 including said baffle plate having a lower edge disposed adjacent to said bundle means top sheet, and first seal means interposed between said lower edge and said top sheet.

3. The heat exchanger assembly of claim 2 including said first seal means having a generally flat base portion in contact with said top sheet, said first seal means having a generally upwardly open channel, and said lower edge of said baffle plate being disposed within said first seal means channel.

4. The heat exchanger assembly of claim 3 including said first seal means being substantially co-extensive with said baffle plate.

5. The heat exchanger assembly of claim 2 including said elongated shell being generally cylindrical and having a front closure and a rear closure, and said baffle plate having an upper edge of generally complementary shape with respect to the adjacent overlying portion of said shell, whereby passage of fluid entering said fluid inlet to said fluid outlet by flow between said baffle plate upper edge and said shell will be resisted.

6. The heat exchanger assembly of claim 5 including said baffle plate upper edge being generally upwardly convex.

7. The heat exchanger assembly of claim 6 including said baffle plate upper edge having a configuration which is generally a portion of a sine wave.

8. The heat exchanger assembly of claim 6 including said baffle plate being substantially planar.

9. The heat exchanger assembly of claim 1 including said bundle assembly top sheet being substantially rectangular, and said baffle plate extending generally from one corner thereof to a diagonally opposed corner thereof.

10. The heat exchanger assembly of claim 1 including said bundle assembly having a transverse cross-sectional configuration which is substantially rectangular.

11. The heat exchanger assembly of claim 10 including a front cover plate secured to the front end of said bundle assembly, and said front cover plate being of greater cross-sectional area than said bundle assembly.

12. The heat exchanger assembly of claim 1 wherein said bundle support means includes an elongated downwardly open channel member having an upper plate portion and depending leg portions secured to said shell.

13. The heat exchanger assembly of claim 12 wherein bundle seal means are interposed between said bottom sheet and said channel upper plate portion for effecting sealing therebetween.

14. The heat exchanger assembly of claim 13 including said bundle seal means having a seal plate member secured to said bottom sheet and projecting downwardly therefrom and second seal means, and said second seal means having a generally flat surface in contact with said channel upper plate portion and an upwardly open channel within which said seal plate member is received, whereby passage of fluid between said bundle assembly and said bundle assembly support means is resisted.

15. The heat exchanger assembly of claim 13 including said bundle assembly means having transport means cooperating with said downwardly open channel member to facilitate insertion of said bundle assembly within said shell and removal of said bundle assembly from said shell.

16. The heat exchanger assembly of claim 15 wherein said transport means includes at least one pair of guide members depending from said bottom sheet and supporting rollers in contact with said channel member, whereby relative rolling movement between said bundle assembly and said shell may be effected.

17. The heat exchanger assembly of claim 16 including said guide members being in close proximity to said channel leg portions, and said rollers being in contact with said channel member upper plate portion.

18. The heat exchanger assembly of claim 1 including said bundle assembly support means cooperating with said elongated shell to define a condensate receipt reservoir, and drain means for permitting removal of condensate from said reservoir to the exterior of said heat exchanger assembly.

19. The heat exchanger assembly of claim 18 wherein said bundle assembly support means includes an elongated downwardly open channel member having an upper plate portion and depending leg portions secured to said shell, and said channel member and the underlying portion of said shell cooperating to define said reservoir.

* * * * *